US012268291B1

(12) United States Patent
Ritchey et al.

(10) Patent No.: US 12,268,291 B1
(45) Date of Patent: Apr. 8, 2025

(54) MASCARA APPLICATOR WITH CONTAINER AND METHOD OF USE

(71) Applicants: Elaine S. Ritchey, Kittanning, PA (US); Kenneth K. Ritchey, Kittanning, PA (US)

(72) Inventors: Elaine S. Ritchey, Kittanning, PA (US); Kenneth K. Ritchey, Kittanning, PA (US)

( * ) Notice: Subject to any disclaimer, the term of this patent is extended or adjusted under 35 U.S.C. 154(b) by 0 days.

(21) Appl. No.: 18/976,716

(22) Filed: Dec. 11, 2024

Related U.S. Application Data

(63) Continuation-in-part of application No. 18/631,214, filed on Apr. 10, 2024.

(60) Provisional application No. 63/508,065, filed on Jun. 14, 2023.

(51) Int. Cl.
*A45D 40/26* (2006.01)
*A46B 9/02* (2006.01)

(52) U.S. Cl.
CPC ..... *A45D 40/267* (2013.01); *A46B 9/021* (2013.01); *A46B 2200/1053* (2013.01)

(58) Field of Classification Search
CPC .. A45D 40/267; A46B 9/021; A46B 2200/106
See application file for complete search history.

(56) References Cited

U.S. PATENT DOCUMENTS 3,921,650 A * 11/1975 Montgomery ..... A45D 40/267 401/128
4,921,366 A * 5/1990 Hurrell ..... A45D 40/267 401/122
5,188,131 A * 2/1993 Toll ..... A45D 40/267 132/218
5,556,214 A * 9/1996 Ascolese ..... A45D 40/267 401/122
5,722,436 A * 3/1998 Vandromme ..... A45D 40/267 401/122
6,067,997 A * 5/2000 Gueret ..... A46B 9/021 132/218
6,505,632 B1 * 1/2003 Toll ..... A45D 40/267 401/122
8,783,268 B2 * 7/2014 Gueret ..... A45D 40/265 132/218
9,028,161 B2 * 5/2015 Stredak ..... A45D 40/267 401/122
9,066,573 B2 * 6/2015 Pires ..... A46B 11/06
9,301,592 B2 * 4/2016 Hofmann ..... A46B 5/0008
(Continued)

*Primary Examiner* — David P Angwin
*Assistant Examiner* — Bradley S Oliver
(74) *Attorney, Agent, or Firm* — Kan Tang-Wai Sutton

(57) ABSTRACT

A mascara applicator having a brush with a pair of opposed free ends disposed as eyelash tools, with a first eyelash separating tool disposed as a non-bristle tip made of a resilient, non-absorbent and flexible material, the brush attached to a wand of the applicator such that the applicator has a T-shape, L-shape, or hockey stick shape and attached such that the eyelash tools are unobstructed by the wand. A container for the applicator has a rectangular lateral cross section and a window to allow visualization of a mascara product quantity stored therein, with a plurality of cleaning elements positioned at an opening of the container adapted to remove and redistribute mascara on the brush as the applicator is removed from the container. A method of use of the applicator and container are included.

18 Claims, 14 Drawing Sheets

(56) References Cited

U.S. PATENT DOCUMENTS

| | | | | |
|---|---|---|---|---|
| 9,545,143 | B1 * | 1/2017 | Jacob | A45D 40/267 |
| 9,730,504 | B2 * | 8/2017 | Thierer | A46B 3/04 |
| 11,284,698 | B2 * | 3/2022 | Fischer | A46B 9/028 |
| 11,510,480 | B2 * | 11/2022 | Limongi | A46B 5/0075 |
| 11,672,321 | B2 * | 6/2023 | Dempsey | A45D 40/265 132/200 |
| 2023/0130417 | A1 * | 4/2023 | De Bardonneche | A46B 5/002 132/317 |

* cited by examiner

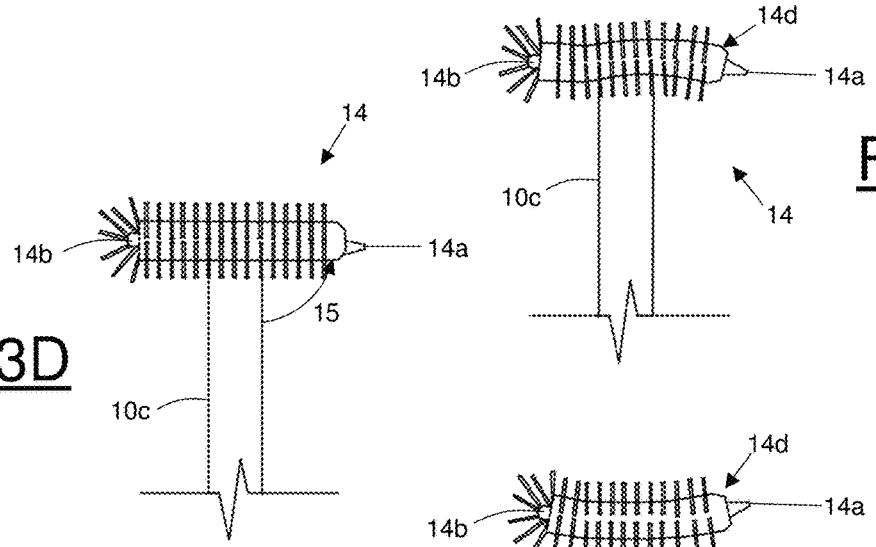
FIG.3D
FIG.3A
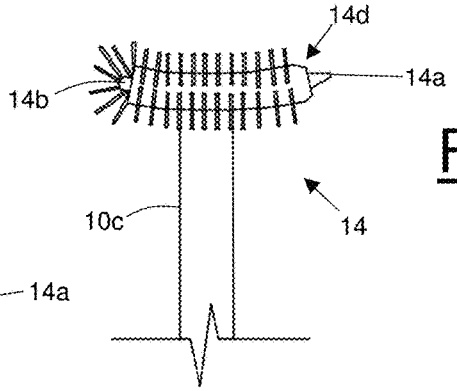
FIG.3B
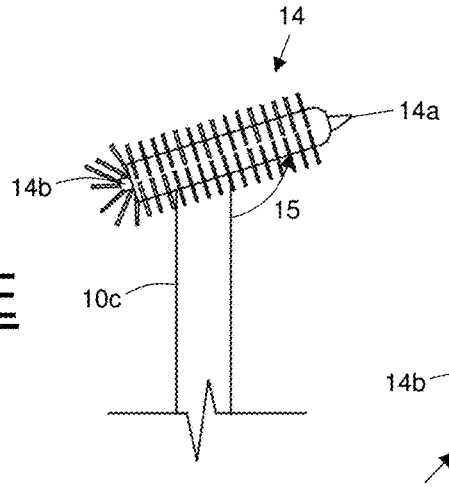
FIG.3E
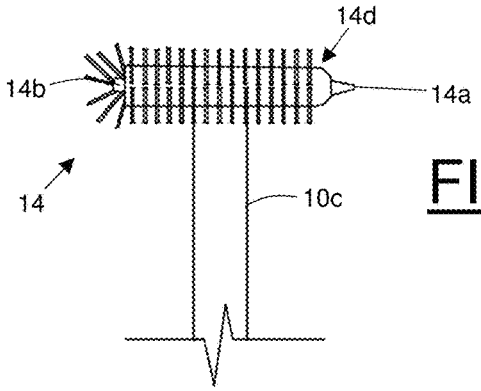
FIG.3C

SECTION A-A

MASCARA APPLICATOR WITH CONTAINER AND METHOD OF USE

CROSS-REFERENCE TO RELATED APPLICATIONS

This application is a continuation in part of U.S. application Ser. No. 18/631,214 filed on 10 Apr. 2024, which itself claims priority to U.S. application Ser. No. 63/508,065 filed on 14 Jun. 2023, whose disclosures in their entirety are hereby incorporated by this reference.

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The invention pertains to the field of cosmetics, specifically, to an improved mascara applicator and mascara container.

Background Art

Long, dark eyelashes are desired by women around the world because they enhance and emphasize the eyes. Mascara is thus a beauty staple for women worldwide, and even women who prefer a more natural look still wear mascara to highlight their eyes. Mascara is applied using a wand applicator having a brush at one end and a handle on the other end. The brush and wand of the wand applicator form a straight line; that is, the brush is at a 180 degree angle from the wand of the applicator, and thus has only one free end, with the other end of the brush attached directly to the wand. The free tip end is thus a lowermost end of the applicator and when inside the cylindrical container, it sits inside the mascara stored inside the container. To use the mascara, the wand applicator is removed from the container, and the user, positioning the handle, wand, user's hand, and brush horizontally and parallel to the lashes, uses an up and down motion with the applicator to apply mascara to the lashes.

A known issue with the wand applicator is that the mascara is easily applied to one eye, typically the eye on a same side as the user's dominant hand, but when mascara is applied to the lashes of the other eye, the user has a more difficult time because the user's nose is in the way, forcing the user to apply the mascara by awkwardly twisting the hand holding the applicator to the other side of the face to try to apply the mascara as best as possible, switching hands and allowing the nondominant hand to do the work, or crossing the dominant hand over the nose and coating the lashes while avoiding the nose. The last method of application is often the easiest, but since the mascara brush tip is now located away from the tear duct side of the eye and away from the user's nose, coating the small lashes near the tear duct side of the eye with the tip is now impossible.

Many women struggle to put mascara onto the lashes of the eye opposite the side of their dominant hands. Even professional makeup artists find it difficult to apply mascara to the lashes of the eye opposite that of their dominant hand because the wand must be held approximately parallel to the lashes and the nose always gets in the way of mascara application. For instance, since the brush only has one useful tip, the tip end being on the opposite the side of the handle of the linear applicator, for a right-handed user, the tip can be used to coat the inner lashes on the right eye easily, but her nose gets in the way when she attempts to coat the inner lashes of the left eye using the tip. Few have the dexterity to simply switch the wand into the other hand to coat the lashes of the other eye.

Another known issue with mascara application is that mascara tends to clump. The cylindrical mascara container and wand applicator design encourages uneven application of mascara onto the brush, with the tip having more mascara and the base having less. Most users will attempt to coat the brush more evenly by wiping the tip on the edge of the opening of the cylindrical container, but this creates a mess at the container opening and still fails to coat the brush evenly. Uneven mascara on the brush prior to application results in clumping and uneven application on the lashes that can be difficult to correct with other tools since mascara dries quickly once applied.

In addition, many women use separate, special tools such as lash combs to help separate the lashes after applying mascara, or they will comb the coated mascara wand to try to even out the mascara prior to applying, but any extra steps must be done quickly before the mascara dries. Most women will try to fix uneven mascara after application and there is a certain danger to the user's eye when using hard, sharp pointy objects like toothpicks and metal lash combs to try to remove the clumps and separate the lashes. Sharp, pointy tools are dangerous but safer plastic ones are too thick to separate the lashes or even out the mascara. There is no way to evenly coat the brush without any special tools due to the fact that the mascara sits in the bottom of the tube and the tip of the brush thus picks up more mascara product due to the physical characteristics of the brush and cylindrical container.

Lastly, mascara is expensive and since every tube of mascara is opaque, it is impossible for the user to know how much product is inside the cylindrical container. The color of the mascara is also impossible to discern looking at the container, particularly when identifying printing on the container exterior easily rubs off and then the only way to know is to open the tube, thus exposing it to more air and degrading the mascara more quickly. Many containers of mascara are discarded while there is plenty of product inside, a wasteful practice encouraged by the cosmetics industry but which is bad for the environment and not economical for the mascara wearer.

What is needed is an improved mascara applicator that allows the user who is left handed or right handed to apply mascara to either eye with equal skill or ease. What is also needed is an integrated mascara applicator and lash separator in a same mascara applicator.

What is also needed is an improved mascara container that allows mascara product to be more evenly distributed onto the mascara brush, allows the user to visually see how much mascara is in the container as well as what color the mascara is, and finally, allows for less waste.

DISCLOSURE OF INVENTION

An applicator and container for mascara and method of using the same is comprised of an applicator having a brush affixed to a wand. The brush is further comprised of a brush body with an array of bristles between a first end and an opposed second end, and a wand attachment point to which the wand is affixed at its brush end and a lid affixed to the wand at its lid end. The brush is attached to the wand at an angle measuring between approximately 80 to 135 degrees as measured from the wand when the brush is in a use position. The wand attachment point is either between the first end and the opposed second end of the brush body, whether in a center of the brush body or to a right side or a left side of the center, or at either the first end or at the opposed second end. The first end is further comprised of a first eyelash tool and the opposed second end is further comprised of a second eyelash tool, wherein the first eyelash tool is an eyelash separating tool having a pointed end and made of a resilient, non-absorbent, and flexible material adapted to separate lashes coated with mascara, with the wand attached to the brush such that the first and second eyelash tools are unobstructed by the wand regardless of the position of the wand attachment point on the brush body.

In a first aspect of the invention, the first eyelash tool is a pointed end made of a resilient and flexible material.

In a second aspect of the invention, the second eyelash tool is a ball-like array of bristles.

In a third aspect of the invention, the brush is one of pivotably, foldably, rotatably, or hingeably affixed to the wand.

In a fourth aspect of the invention, the applicator is T-shaped, L-shaped, or hockey stick shaped.

In a fifth aspect of the invention, the mascara container adapted for use with the applicator comprises a container body having a rectangular opening and an interior space having a rectangular cross-section.

In a sixth aspect of the invention, the mascara container is further comprised of a window formed into the container body, wherein the interior space is visible through the window.

In a seventh aspect of the invention, the mascara container is further comprised of a plurality of finger-like cleaning elements arranged on opposed sides of the rectangular opening.

In an eighth aspect of the invention, the cleaning elements are removably affixed to the rectangular opening of the mascara container and made of silicone.

In a ninth aspect of the invention, a method of applying a quantity of mascara to a user's first set of eyelashes and second set of eyelashes using a mascara applicator with a wand and a brush, with the brush angled between approximately 80 degrees and 135 degrees from the wand, the brush further having a tip end and a ball end, and a mascara container housing a quantity of mascara, comprising the steps of removing the applicator from the mascara container with a user's dominant hand, positioning the dominant hand and the applicator on either a left side or a right side of a user's nose near the first set of eyelashes to be coated, holding the applicator such that the wand is either approximately vertical and perpendicular to or below the first set of lashes to be coated, moving the applicator and brush up and down to coat the first set of eyelashes, positioning the dominant hand and the applicator to an opposite side of the user's nose near the second set of eyelashes to be coated, and repeating the steps of holding and moving until the second set of eyelashes are coated.

In a tenth aspect of the invention, the method further comprises the steps of coating a plurality of eyelashes closest to the user's nose using the ball end of the brush before or after the step of moving.

In yet another aspect of the invention, the method further comprises the step of redistributing mascara product on the brush by moving the brush against the cleaning elements after the step of removing and before the first step of positioning and when the mascara container used in the method is further comprised of a rectangular opening with cleaning elements positioned on opposed sides of the opening.

In a final aspect of the invention, the first step of positioning in the method is further comprised of positioning either the ball end or the tip end closest to the user's nose.

BRIEF DESCRIPTION OF THE DRAWINGS

The features and advantages of the invention will become apparent from a consideration of the subsequent detailed description presented in connection with accompanying drawings, in which:

FIGS. 3A-E are diagrammatic representations of some useful embodiments of the brush of the applicator according to the invention.

DRAWINGS LIST OF REFERENCE NUMERALS

Figure 1:
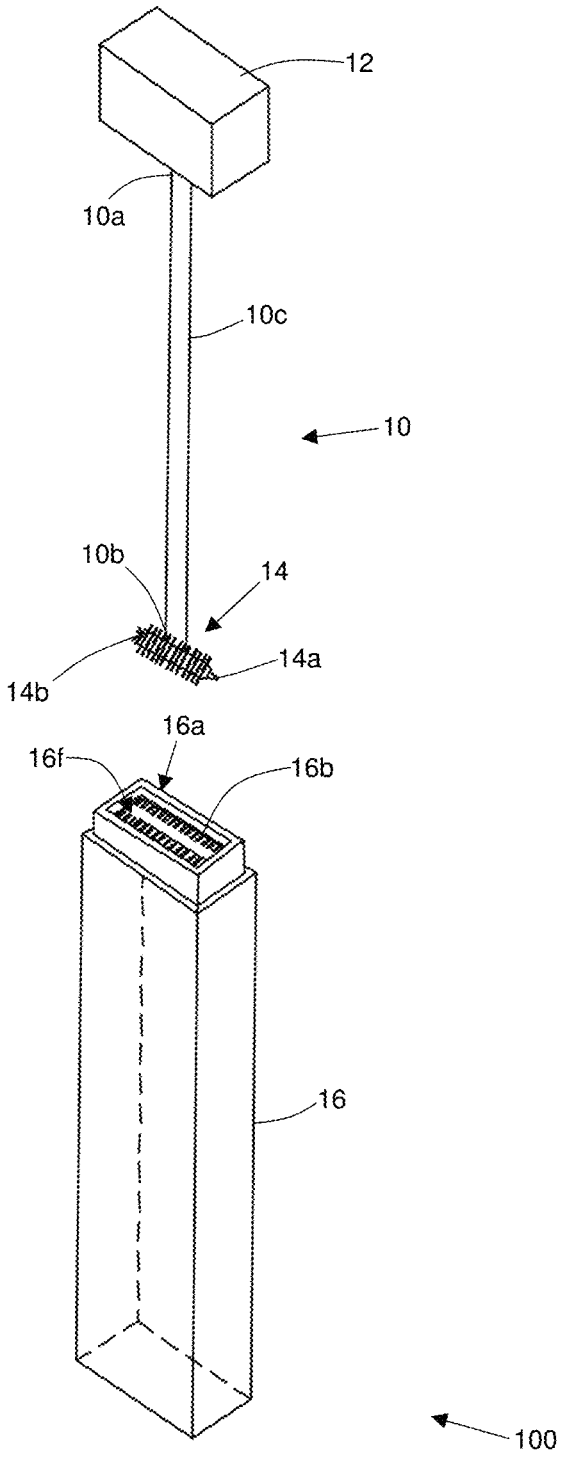
FIG. 1 is an exploded view of an applicator and container according to the invention.

The following is a list of reference labels used in the drawings to label components of different embodiments of the invention, and the names of the indicated components:

100 improved mascara applicator and container
10 applicator
10*a* lid end
10*b* brush end
10*c* wand
12 lid (serves as a handle for the applicator and lid for container)
12*a* inner wall
14 mascara applicator brush or brush
14*a* first end or tip end
14*b* second end or ball end
14*c* wand attachment point
14*d* brush body
15 brush angle
16 container
16*a* opening
16*b* cleaning members
16*c* window
16*d* coupler
16*e* mascara
16*f* interior space
18 user
18*a* dominant hand of user or user's dominant hand
18*b* user's dominant eye
18*c* user's nondominant eye
18*d* user's nose
20 prior art applicator
22 prior art tip
24 prior art brush

DETAILED DESCRIPTION

Figure 10:
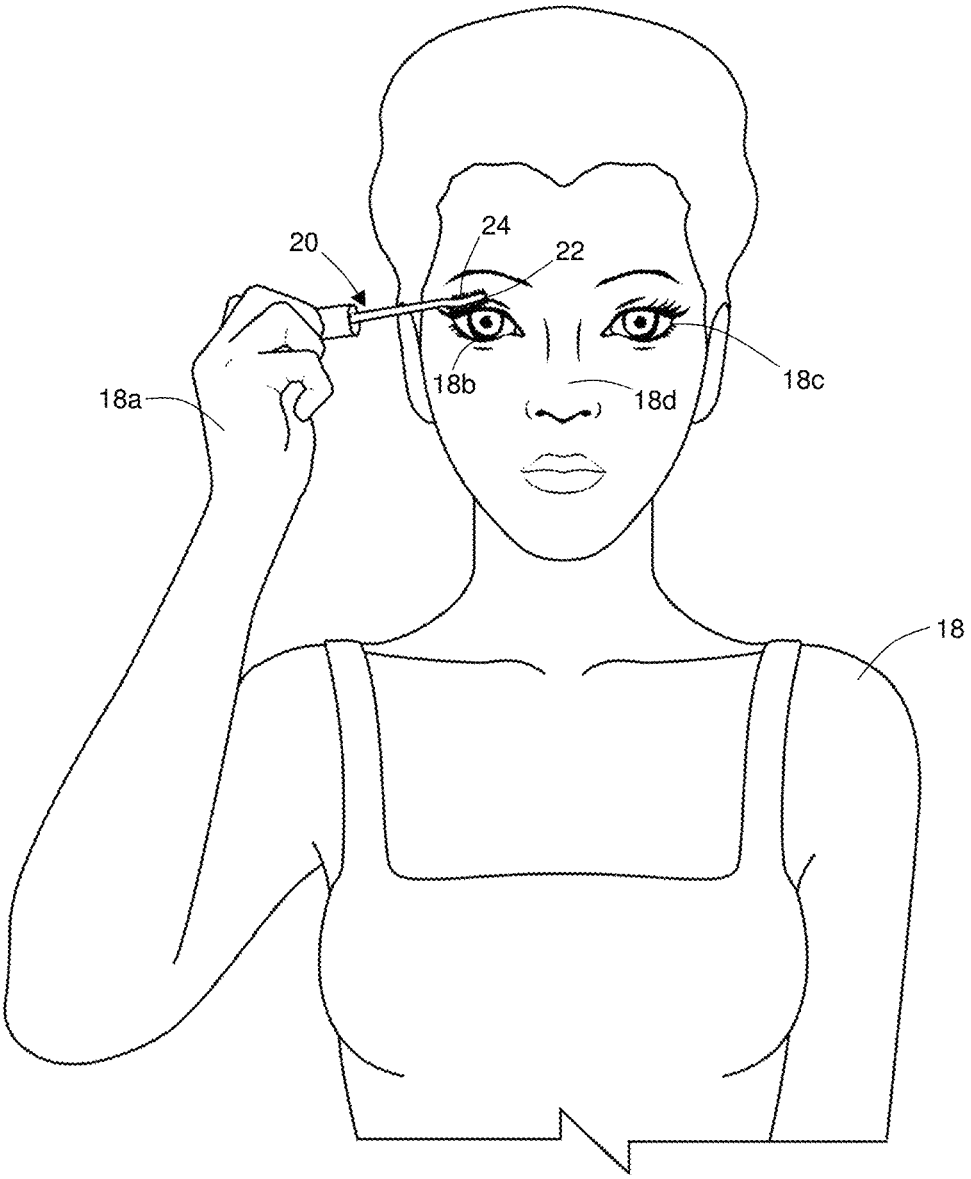
FIG.10 PRIOR ART
FIG. 10 is a front elevation view of a prior art mascara application step where a user holding a prior art applicator in a dominant hand positions the applicator to apply mascara to an eye located on a same side of a user's body as the dominant hand.
Figure 11:
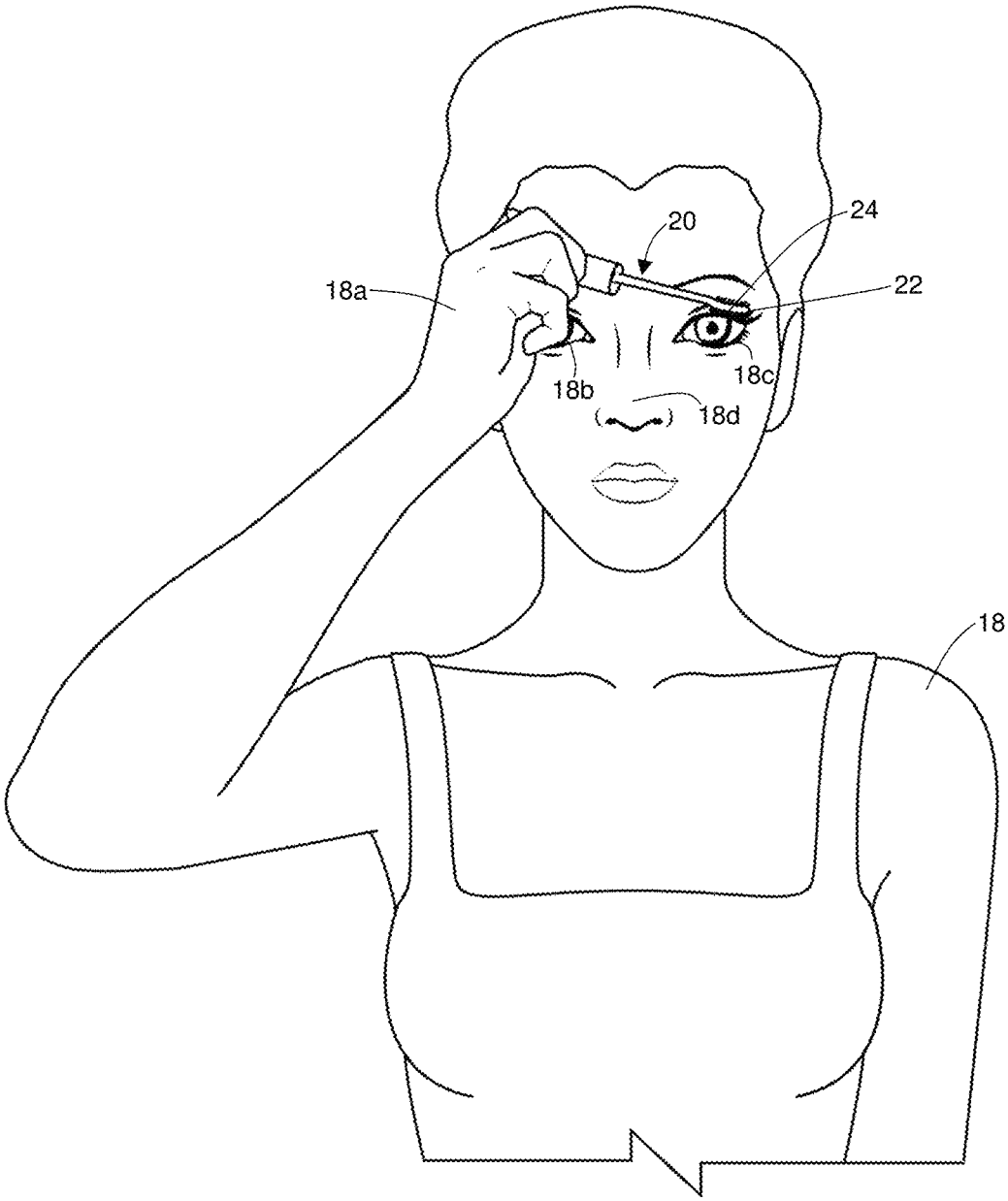
FIG.11 PRIOR ART
FIG. 11 is a front elevation view of a first prior art mascara application step where the user holding the prior art applicator in the dominant hand positions the applicator on an opposite side of the user's body as the dominant hand to apply mascara to an eye located on the opposite side of the user's body as the dominant hand, and where a tip end of the prior art applicator is positioned away from a nose of the user.
Figure 12:
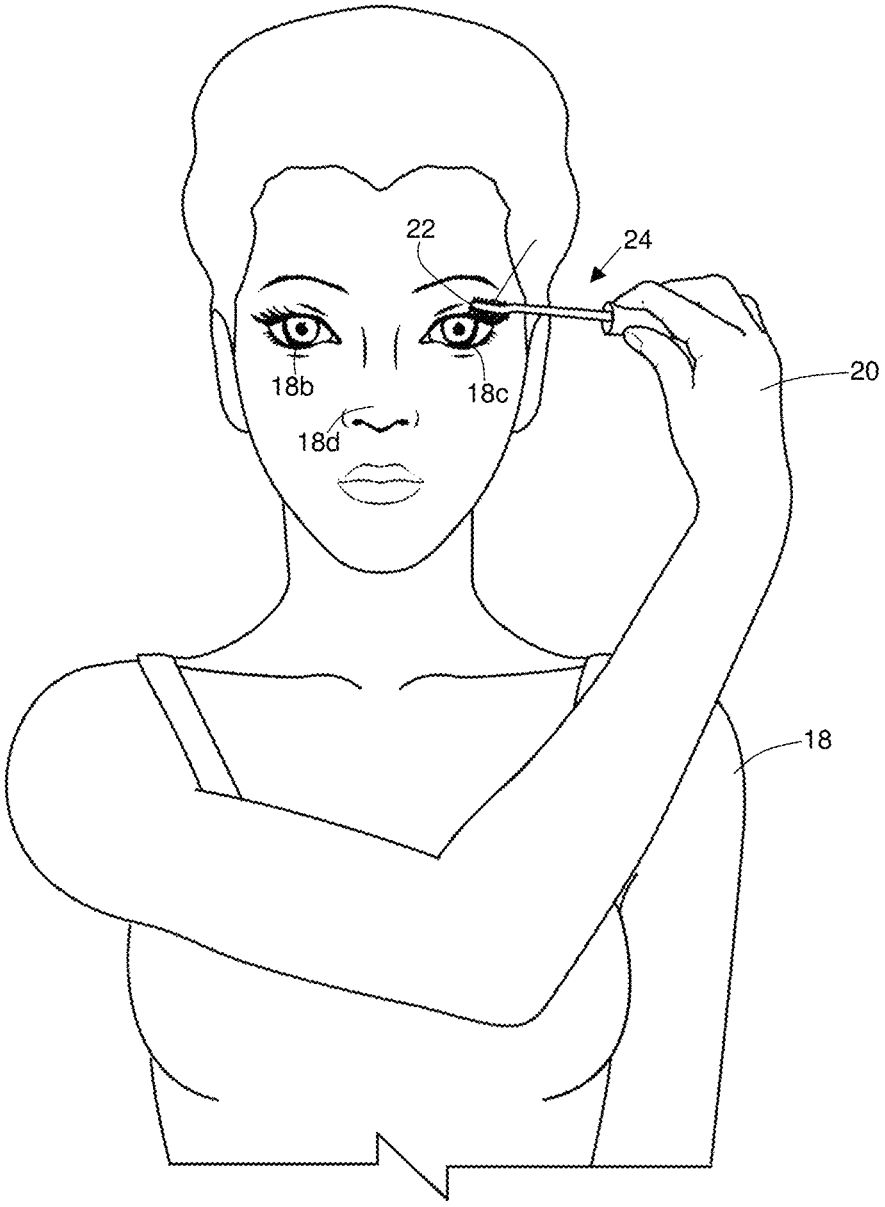
FIG.12 PRIOR ART
FIG. 12 is a front elevation view of a second prior art mascara application step where the user holding the prior art applicator in the dominant hand positions the applicator on the opposite side of the user's body as the dominant hand to apply mascara to the eye located on the opposite side of the user's body as the dominant hand, where the tip end of the prior art applicator is positioned towards the nose of the user.

An improved mascara applicator and container according to the invention 100 or invention 100 is comprised of an applicator 10 and a container 16, shown in FIGS. 1-9. A method of applying mascara using the applicator 10 is partially illustrated in FIGS. 13-14, with FIGS. 10-12 showing steps for using a prior art mascara applicator 20 and its brush 24.

Turning now to FIGS. 1-9, the applicator 10 has a wand 10*c* having a lid end 10*a*, to which a lid 12 is affixed, the lid 12 also serving as a handle of the applicator 10, and an opposed brush end 10*b* affixed to wand attachment point 14*c* of a mascara applicator brush or brush 14 having a brush body 14*d*, a first end or tip end 14*a*, an opposed second end or ball end 14*b* and the wand attachment point 14*c*. The inventor notes that in the FIGS., the tip end 14*a* is a first outermost end of the brush body 14*d*, configured into a first eyelash tool having a narrow tip adapted to separate lashes coated with mascara. The tip end 14*a* is made of a resilient, non-absorbent, and flexible material with a base at the first outermost end of the brush body 14*d* being wider than the tip end 14*a*. The tip end 14*a* is not configured as one or more bristles, as the inventor notes a single bristle tends to be too flexible to effectively separate eyelashes that are sticking together, and an array with multiple bristles, arranged together to form a tip, are generally too thick for effective eyelash separation. The ball end 14*b* is a second outermost end of the brush body 14*d* and a second eyelash tool upon which a ball-like array of bristles protrudes from the ball end 14*b* but is not a part of the ball end 14*b*. The inventor notes that in other embodiments, not shown, the tip end 14 and the ball end 14*b* may in fact be two differently configured pointy tips or other shaped eyelash tools, or in the case of the second eyelash tool have different arrays of bristles, hence the tip end 14*a* and the ball end 14*b* in the FIGS. are illustrative only of one typical embodiment and is not meant to limit the invention to just what is shown. Thus while the use of "tip end" refers specifically to the first end of the brush body 14*d* and to a pointed tip eyelash separating tool made of a non-absorbent, resilient and flexible material, the "ball end" refers to the opposite end of the brush body 14*d* and could be an the bristle ball shown in the FIGS., or a second pointy tip eyelash separating tool with a same or different physical characteristics as what is shown in the FIGS., such as being pointed, rounded, etc.

The wand attachment point 14*c* is defined in this disclosure as an attachment point for the wand's brush end 10*b* to the brush body 14*d* at any location on the brush body 14*d* that allows the tip end 14*a* and the ball end 14*b* to function without interference from the wand 10*c*, regardless of the actual configuration of the ends 14*a* 14*b*. The wand attachment point 14*c* thus cannot be attached to the tip end 14*a* shown in the FIGS. as this would render the utility of the pointy tip of the tip end 14*a* useless for separating lashes, but the inventor notes that the wand attachment point 14*c* can be in fact at either the first (tip) end 14*a* or the second (ball) end 14*b* provided that the use and utility of the ends 14*a* 14*b* are unhindered or unimpeded by the location of the wand 10*c*. For instance, a flattened brush end 10*b* of the wand 10*c* could be attached to the ball end 14*b* and not otherwise interfere with the ball-like array of bristles on the ball end 14*b*, or the array at the ball end 14*b* may simply be configured with a plurality of longer bristles such that the wand 10*c* is out of the way.

Figure 2:
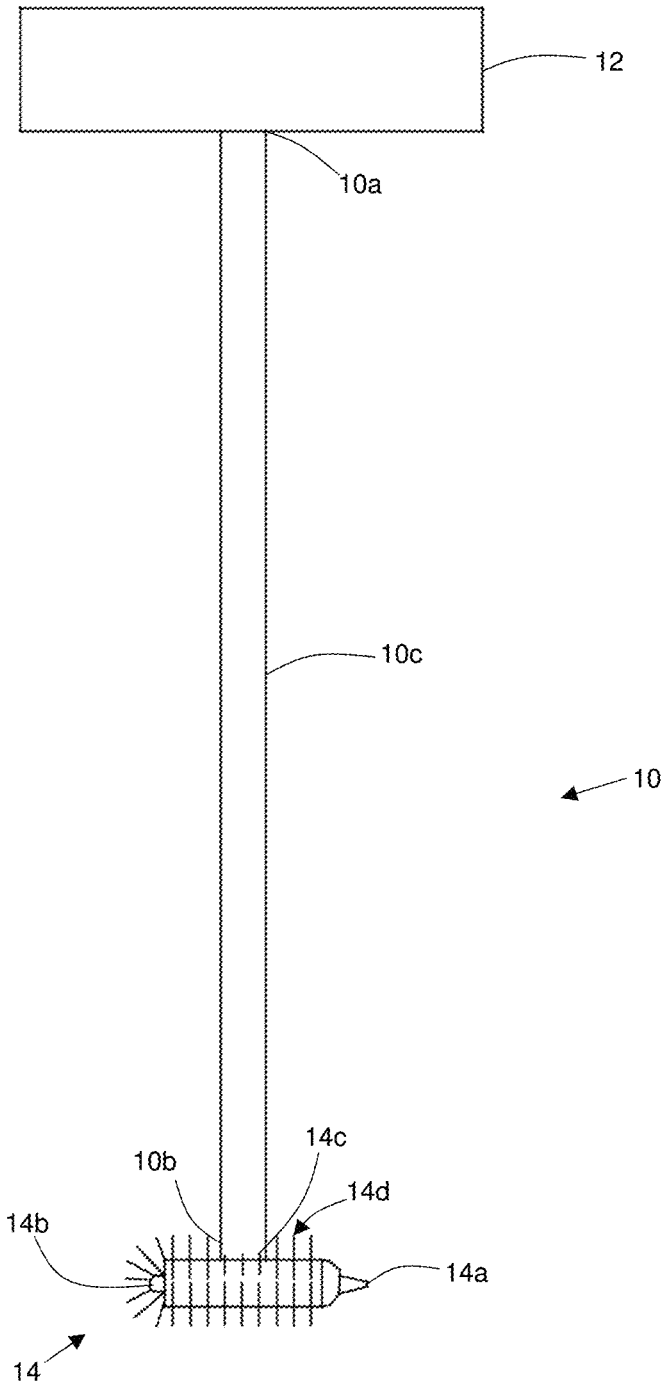
FIG. 2 is front elevation view of the applicator in FIG. 1.
Figure 4:
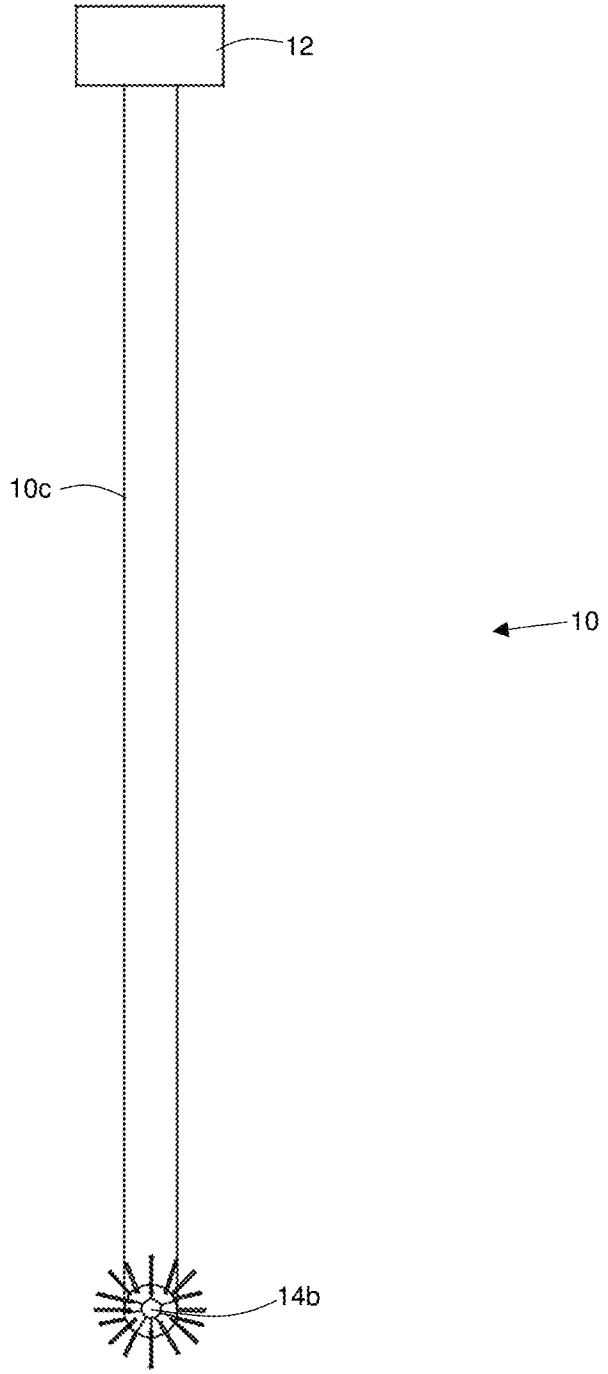
FIG. 4 is a side elevation view of a ball end of the applicator in FIG. 1.
Figure 5:
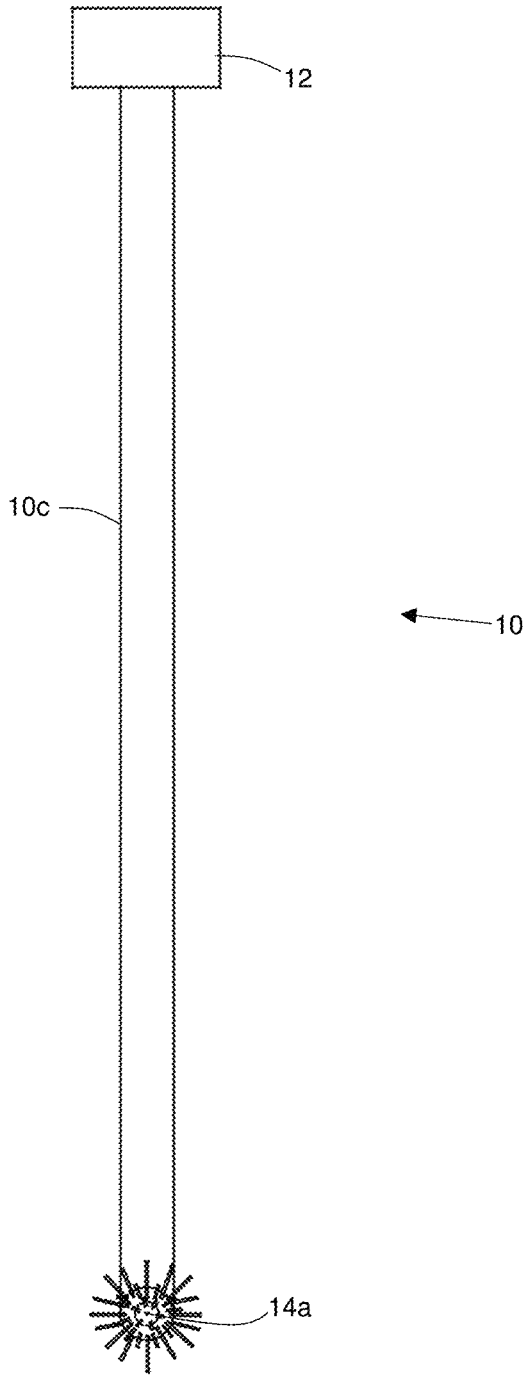
FIG. 5 is a side elevation view of a tip end of the applicator in FIG. 1.
Figure 6:
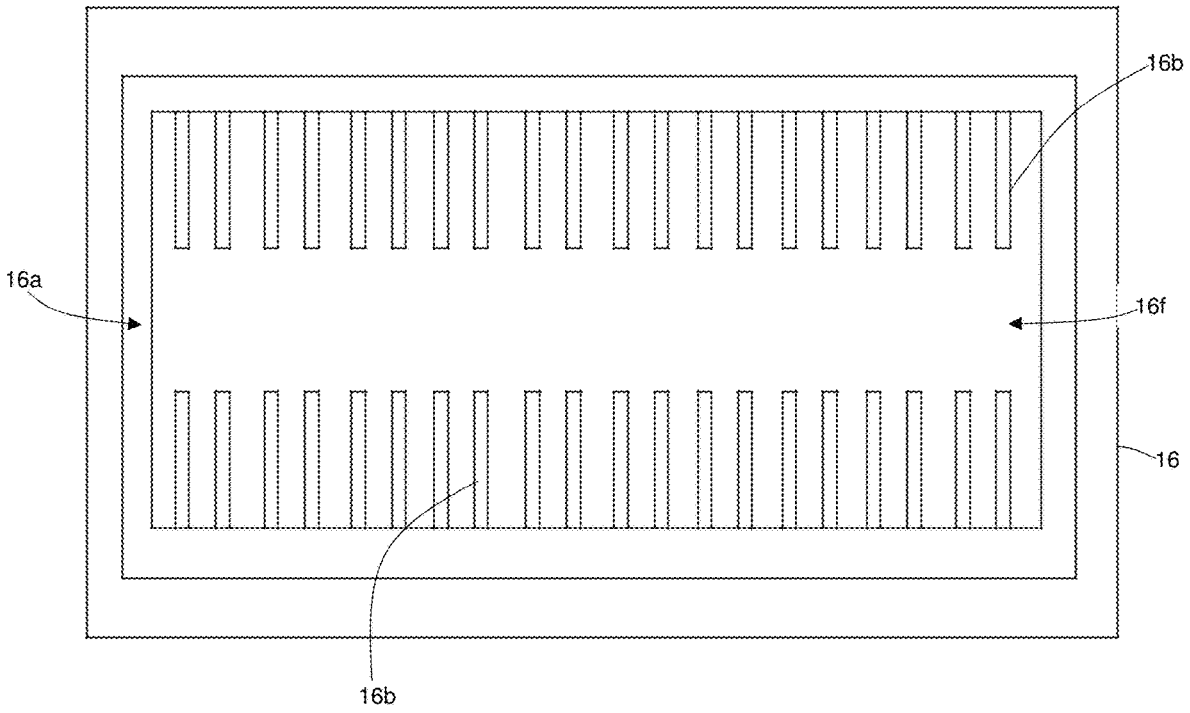
FIG. 6 is a top view of the container in FIG. 1.
Figure 7:
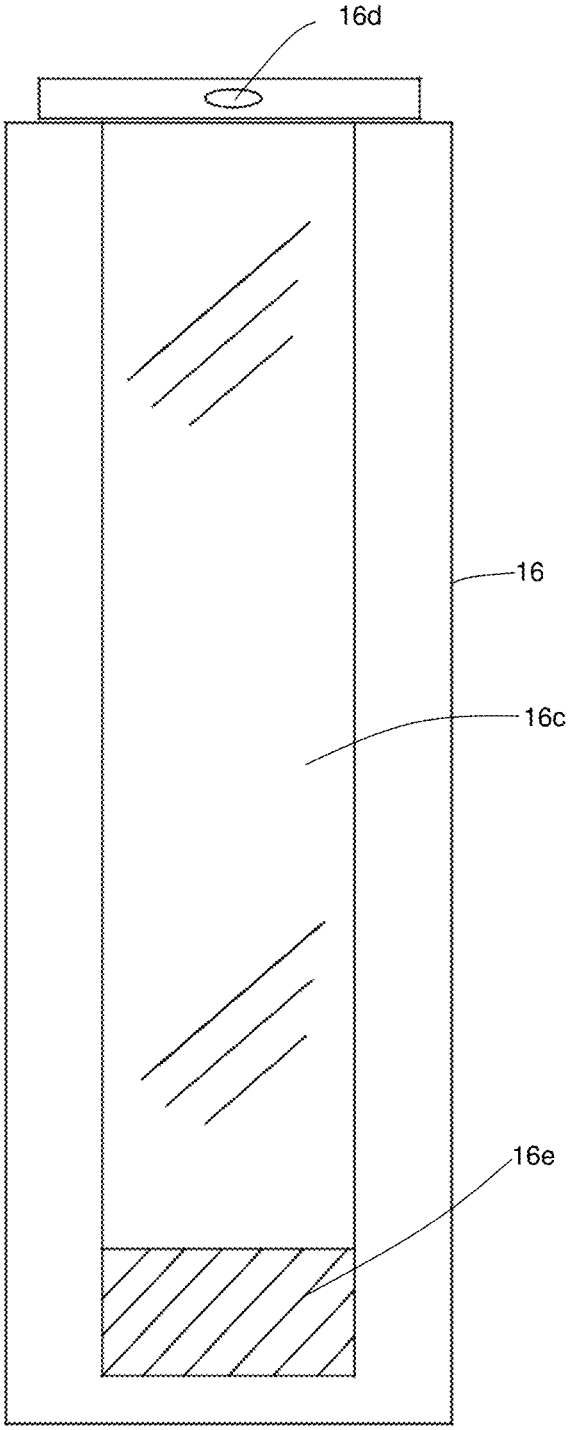
FIG. 7 is a front elevation view of the container in FIG. 1.
Figure 8:
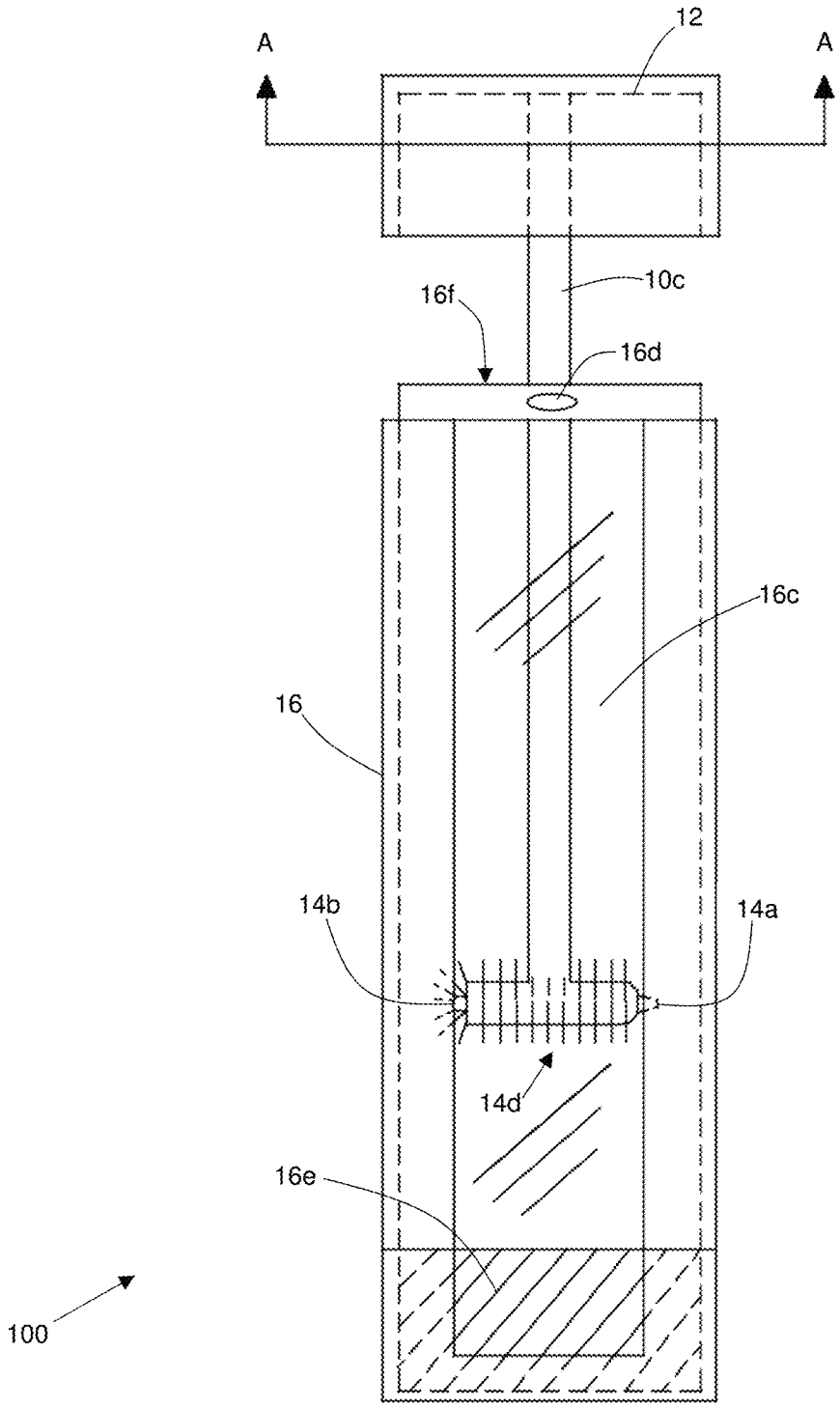
FIG. 8 is a front view of the applicator and container in FIG. 1, with the applicator shown partially inside an interior space of the container.
Figure 9:
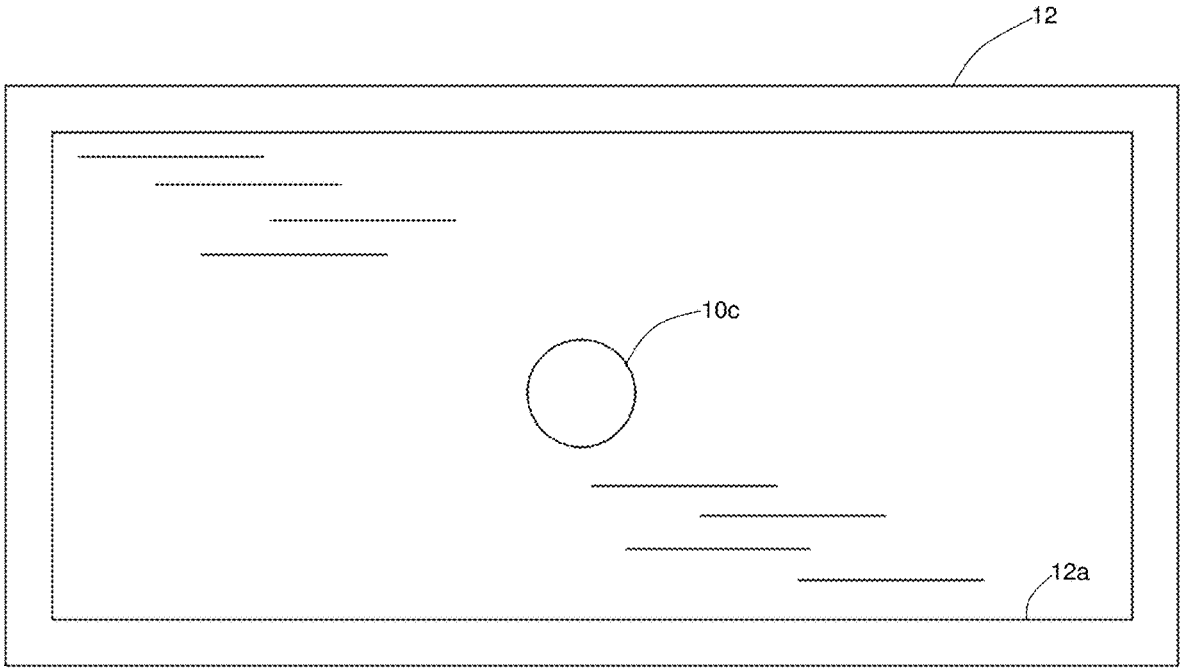
FIG. 9 is a section view of FIG. 8 showing an interior of a lid.

In the embodiment shown in FIG. 2 for instance, the applicator 10 visually resembles a push broom with the brush end 10*b* of the wand 10*c* affixed centrally to the brush body 14*d* at the wand attachment point 14*c*, where the brush 14 is perpendicular to the wand 10*c*. In the embodiment shown in FIG. 3E for instance, the wand attachment point 14*c* is off center. Hence, the FIGS. illustrate some typical wand attachment points 14*c* but are not meant to limit the invention to just what is shown in the FIGS.

For the applicator 10, an angle 15 of the brush 14 in relation to the wand 10*c* is at either approximately a right angle, as shown in FIG. 3D, or an obtuse angle, as shown in FIG. 3E, but is never a straight line, defined here as the brush 14 having a 180 degree angle as measured from the wand 10*c*. In contrast, in the prior art, shown in FIG. 10 for instance, a prior art brush 24 has a 180 degree angle with a prior art wand, resulting in a prior art applicator 20 forming an approximately straight line and resulting in only one useful end 22 of the brush 24. In the embodiments shown in the FIGS., such as in FIG. 3C, the wand attachment point 14*c* is in fact at the center of the brush body 14*d*, where the brush 14 is perpendicular (at a right angle, or 90 degrees) to the wand 10*c*, resulting in a T-shaped applicator. In FIG. 3E, the wand attachment point 14*c* is off center of the brush body 14*d*, with the angle 15 of the brush 14 being the obtuse angle of approximately 100 degrees, resulting in an approximately L-shaped or hockey stick shaped applicator. The angle 15 can range from approximately 80 degrees (acute angle) to approximately 135 degrees (obtuse angle) as measured from the wand 10*c* to the brush 14 and the range is defined in this disclosure as "largely perpendicular" or "approximately perpendicular".

Thus, references in this disclosure to T-shaped, L-shaped, or hockey stick shaped applicators 10 all have the following in common: the brush 14 in relation to the wand 10*c* has the angle 15 ranging from approximately 80 degrees up to approximately 135 degrees, i.e. largely perpendicular or approximately perpendicular, with any angle above 135 degrees and approaching 180 degrees to be less useful and will have the similar issues as the prior art applicator 20. The angle 15 is irrespective of a shape of the brush 14, with some brush shape examples shown in FIGS. 3A-C where brush shapes are provided as examples of the types of shapes that might be useful but which do not impact the brush 14 angle relative to the wand 10*c*.

In short, the brush 14 and wand 10*c* cannot be arranged so as to be in a straight 180 degree line, which is the prior art, or otherwise oriented so that the brush 14 and wand 10*c* are parallel when in a use position as is the case with the prior art applicator 20 in FIG. 10.

The array of bristles arranged on the brush body 14*d* and the ball-like array on the ball end 14*b* may be of any suitable material, including plastic, rubber, silicone, or other materials used in prior art mascara brushes. The tip end 14*a* is pointed, and typically made of rubber, silicone or other resilient material that maintains its shape but is flexible, with a size and shape adapted to separate newly mascara-coated lashes that are sticking together, by a user 18 using the tip end 14*a* to comb through or otherwise separate mascara-coated lashes for a fuller lash effect. The inventor notes that the use of a flexible material prevents accidental injury to the user 18 should the tip end 14*a* contact an eye of the user 18. The flexible material is an effective lash separating tool because the tip end 14*a* is used immediately after mascara application and before the mascara has time to dry and is faster to use than putting the applicator 10 back into the container 16 and picking up a separate prior art lash separator tool.

In contrast, current prior art lash separator tools are typically made of metal or rigid plastic and can easily injure the eye of the user 18. In particular, these separator tools are most useful only if they are provided with a narrow tip, and thus safer plastic designs are often too thick or wide to be effective, and metal pins, while effective because of their thin profile, are dangerous used near the eye. A rubber or silicone tip end 14*a* however could contact the eye of the user 18 and not cause injury yet have the desired thin tip profile approximating that of a needle. Lash separators are often made of metal or other rigid materials because mascara dries quickly, and a flexible lash separator is ineffective for separating lashes where the mascara has dried, even if it is not completely dried.

The ball end 14*b* of the brush 14 shown in the representative embodiment in the FIGS. with the ball 0-like array of bristles protruding from the ball end 14 allow the user 18 to coat small lashes more easily, particularly near a nose 18*d* of the user 18, where space is limited. The array of bristles on the ball end 14*b* may be of a same length or varying lengths to provide the user 18 additional coating options and may mimic an array of bristles on the brush body 14*d* or differ from it. To emphasize, while the ball end 14*b* is shown in the FIGS. with the rounded array of bristles, it could also be configured as another lash separator tip with a different sized tip, or other useful or desired shapes, and thus the applicator 10, by joining the wand 10*c* to the brush body 14*d* in an approximately perpendicular relationship, has an additional useful eyelash tool impossible to incorporate into the prior art applicator 20. The tip end 14*a*, ball end 14*b* and the array of bristles of the brush body 14*d* may all be made of a same or different materials, as desired.

The inventor notes that in the prior art, since the prior art brush 24 of the prior art applicator 20 is attached to a brush end of the wand at one end of the brush 24 as shown in FIGS. 10-12, the prior art brush 24 has only one useful end or prior art tip 22 that can be used to coat the user's lashes. Many prior art applicators 20 feature the ball-like array of bristles on its only free tip end, or other shaped end designed to target hard to coat areas of the lashes, particularly shorter lashes along the inner eye, lower lashes, or individual lashes. However, given that there is only a single useful tip 22 of the prior art brush 24, it has proven to be difficult to design this end to perform all things well, and thus most prior art brush ends are designed for mascara coating, with varying degrees of utility as judged by individual users. In fact, the success or failure of a mascara product hinges both on the mascara formulation itself and on the characteristics of the prior art brush 24 and prior art applicator 20, and a brush's lack of features or features that are difficult to use or fail to coat the lashes in a sufficient way can often spell doom for an otherwise excellent mascara formulation. The inventor's applicator 10 thus provides two useful and different ends on the brush 14, eliminating the need for additional, separate lash tools.

In an especially useful embodiment, shown in FIGS. 3A-C, the brush body 14*d* can be shaped by the user 18 into a variety of custom shapes, including C-curves, S-curves, and a variety of different bends as desired. FIGS. 3A-C shows some useful shapes; however, these shapes are examples only of some possible configurations of the brush body 14*d* are not meant to be limiting the brush body 14*d* shape to just what is shown. In another embodiment, the brush body 14*d* is pre-shaped into a nonadjustable C-curve or other useful shape.

The ability to shape the brush body 14*d* into an individualized desired shape by the user 18 or sold with a predetermined shape is particularly useful because eye shape is highly individualized and many of the problems with the prior art applicators 20 occur because there is no universal eye shape, and the chosen shape thus is not universally useful. The inventor notes that eye and lid shape are not all the same, with some eyes having a more flattened profile while others are more curved, as is well known and acknowledged by the wide range of eyelash curlers available which feature varying curved profiles to match different ethnic eye shapes, with more flattened shapes popular in East Asia and more curved shapes popular in Western Europe. Providing a brush 14 whose brush body 14*d* can be manipulated into customized shapes provides the user 18 a unique, individualized experience that is currently unavailable in the prior art. In the prior art, the brush 24 has a predetermined shape that is not designed to be bent or otherwise altered, and the inventor notes that a shape of the prior art container, being cylindrical, only easily accommodates brushes 24 that are mostly linear in shape. Some prior art brushes 24 are now configured with a curve but those brushes are very flexible to allow them to be pulled out of the prior art container and some users find these flexible shaped brushes too flexible for their needs. The inventor notes that prior art brushes 24 may be symmetrical or asymmetrical, with varying brush widths along the brush body to assist the user's application of the mascara. Despite the large array of prior art brushes 24, there is no brush available that is designed to allow the user 18 to self-configure the brush profile in a way that can always be used with the existing prior art container.

The inventor notes that in another embodiment, not shown, the brush body 14*d* may have a pivotable connection or relationship with the brush end 10*b* of the wand 10*c*, which would allow the applicator 10 to be stored in a conventional cylindrical container used in the prior art by the wand attachment point 14*c* folding so that the brush 14 is approximately parallel to the wand 10*c* when stored in the conventional cylindrical container used in the prior art. The pivotable connection may be a spring hinge that automatically opens when the brush 14 exits the container, or it may be manually pivoted by the user 18, or the wand attachment point 14*c* made of a resiliently flexible material to allow bending or folding when the brush 14 is positioned back into the conventional cylindrical container but which automatically springs open into the desired L-shape or hockey stick shaped applicator 10 when removed from the cylindrical container and in a use position, as shown for instance in FIG. 3E. A storage position of brush 14 when used with the prior art container thus will have an angle of less than 80 degrees. In yet another embodiment, not shown, the brush 14 is rotatably attached to the brush end 10*b* of the wand 10*c*, and thus when removed from or reinserted into the container 16, the brush 14 can rotate and potentially be more uniformly coated with mascara 16*e*. A rotatable brush 14 may also help the user 18 more uniformly apply mascara 16*e*.

Focusing now on the mascara container 16, the inventor notes that the prior art cylindrical container shape necessarily dictated the shape of the prior art applicator. The cylindrical container provided an easy and secure way to affix the lid of the container by threading the container opening and the lid interior, and the narrow shape helped consolidate mascara 16*e* inside a bottom of the prior art container where it could be reliably accessed, albeit by mostly the tip of the brush 24.

Turning to the container 16 of the invention 100, the container 16 has a rectangular opening 16*a*, an interior space 16*f* housing a quantity of mascara 16*e*, and where the interior space 16*f* has a rectangular prism shape to complement a shape of the applicator 10. In other words, the interior space 16*f* has a rectangular cross section when cut laterally. In a preferred embodiment, when the applicator 10 is inside the container 16, the container interior space 16*f* is sized to allow enough clearance for the brush 14 to slide in and out of the opening 16*a* of the container 16 but ideally with minimal lateral movement within the interior space 16*f*. At least one side of the brush 14 is evenly dipped into the quantity of mascara 16*e* housed inside the container 16. In a first embodiment, the mascara 16*e* is housed in a single walled container having a transparent window 16*c* allowing the user 18 to easily see the amount of mascara 16*e* in the container 16 as well as a color of the mascara 16*e*. In a second embodiment, the container 16 is further housed in a separable, decorative outer container, and optionally with or without the transparent window 16*c*. For the second embodiment, the outer container will look like the container 16 in the FIGS. and the inner container is ideally simplified in design and materials. Since the inner container is meant to snap into the outer container, it can thus be thinner and less sturdy, saving on material costs and landfill waste. The inventor notes that the container 16 ideally is designed to more closely fit the brush 14 as compared to the fit of prior art brushes 24 with their containers, resulting in less material required to make the container 16 and also minimizing an amount of air space inside the container 16 that causes mascara 16*e* to dry and degrade when the mascara container is first opened and thereafter. In contrast, in the prior art, the prior art container is always tubular and sturdy, to avoid physical damage, and there is typically always some lateral movement allowed of the prior art applicator 20 inside the prior art container.

The container 16 has a pair of opposed cleaning members 16*b* positioned around the opening 16*a* of the container 16, such that when the applicator 10 is pulled out of the container 16, the brush 14 loaded with mascara 16*e* pulls across the cleaning members 16*b*, allowing excess mascara 16*e* to be removed from the brush body 14*d* of the applicator 10. The cleaning members 16*b* are typically positioned inside the opening 16*a* and removal of the applicator 10 automatically causes the brush 14 to contact the cleaning members 16*b*, removing excess mascara 16*e* and redistributing mascara 16*e* on the brush 14 to allow the user 18 a more even application experience.

A known problem with the prior art is that the prior art brush 24 is often overloaded and unevenly loaded with mascara and the only way to remove the excess is to attempt to wipe the brush 24 along the opening of the prior art container. Such use of the opening does not result in even distribution of mascara and worse, it now introduces mascara to the opening of the container, where it can dry out, become a substrate for bacterial growth, and otherwise cause a mess each time the prior art applicator 20 is stored inside or removed from the prior art container. The dried mascara along the prior art container opening is forever being reintroduced to the brush 24 and thus to the user's eye, and bacterial infiltration as well as degradation of mascara are the two reasons why users 18 are advised to throw away mascara even if sufficient mascara remains inside the prior art container.

For the present invention, the cleaner elements 16*b* can be easily cleaned by using a clean brush or lint free cloth to remove the excess mascara, or in another embodiment, the cleaner elements 16*b* are removably affixed to the container 16 and thus can be removed for cleaning using soap and water, or makeup remover, as needed. The removable cleaning elements 16*b* can be configured as a separate "snap on" style accessory that fits over the opening 16*a* and is adapted to receive the lid 12 so as to not interfere with closure of the container 16, using known methods of pressure fitted closures such as a pressure fitting button 16*d* shown in FIG. 7 that is commonly used for lipstick cases. The lid 12 has an inner wall 12*a* that slides over the opening 16*a* and allows the lid 12 to snap onto the container 16 using the button 16*d*. In some other embodiments, the cleaning elements 16*bs* are disposed as bristles resembling that of the applicator 10 and made of a same material; in other embodiments, the cleaning elements 16*b* are soft rubber or silicone structures with soft tips that comb through the brush 14 and can be easily wiped clean with a tissue after use.

FIGS. 10-12 show three prior art method steps for applying mascara using the prior art applicator 20 where the brush 24 is attached to the wand such that the brush 24 has one free end or prior art tip 22, such that the prior art applicator 20 is configured as an approximately 180 degree linear mascara application tool. In FIG. 10, the user 18 is right handed, and thus a dominant hand 18*a* of the user 18 in the FIGS. is shown as the user's right hand. The inventor notes that the dominant hand 18*a* could also be a left hand for a left-handed user and thus the FIGS. are not meant to be limiting but merely illustrative of method steps for the prior art and for the present inventive method. References to a dominant eye 18*b* in this disclosure means an eye of the user 18 on a same body side as the dominant hand 18*a* of the user 18, and in the FIGS. this is a right eye of the user 18, with a nondominant eye 18*c* thus a left eye of the user 18.

For the prior art method of applying mascara to the dominant eye 18*b* of the user 18, shown in FIG. 10, the user 18 holds the prior art applicator 20 in her dominant hand 18*a*, and applies mascara to the dominant eye 18*b*, with the prior art tip 22 of the prior art applicator 20 pointing towards the nose 18*d* of the user 18 and the dominant hand 18*a* is on a same body side of the user 18 as that of the dominant eye 18*b*. The user 18 sweeps the prior art brush 24 through the lashes in a diagonal or up and down motion. This motion is simple and the prior art tip 22 is positioned towards a nose 18*d* of the user for use to coat inner lashes of the dominant eye 18*b*.

To apply mascara to the nondominant eye 18*c*, FIGS. 11-12 illustrate two common methods: moving the dominant hand 18*a* across the user's face and nose 18*d*, with the prior art tip 22 now positioned away from the nose 18*d* as shown in FIG. 11, or by the user 18 twisting the dominant hand 18*a* to position the prior art tip 22 towards the nose 18*d* as shown in FIG. 12. It is well known in the prior art method of applying mascara that applying mascara to the nondominant eye 18*c* is challenging because of the necessary dominant hand 18*a* positions and the challenge to position the prior art tip 22 so as to be useful to coat the inner lashes towards the nose 18*d*. A more ergonomic hand position, as in FIG. 11 results in the loss of use of the prior art tip 22, and the less ergonomic hand position, as in FIG. 12, retains the prior art tip 22 function but is much more challenging for the user 18 due to the awkward hand position and the required arm flexibility and dexterity needed that further challenges good mascara application to the nondominant eye 18*c*.

Figure 13:
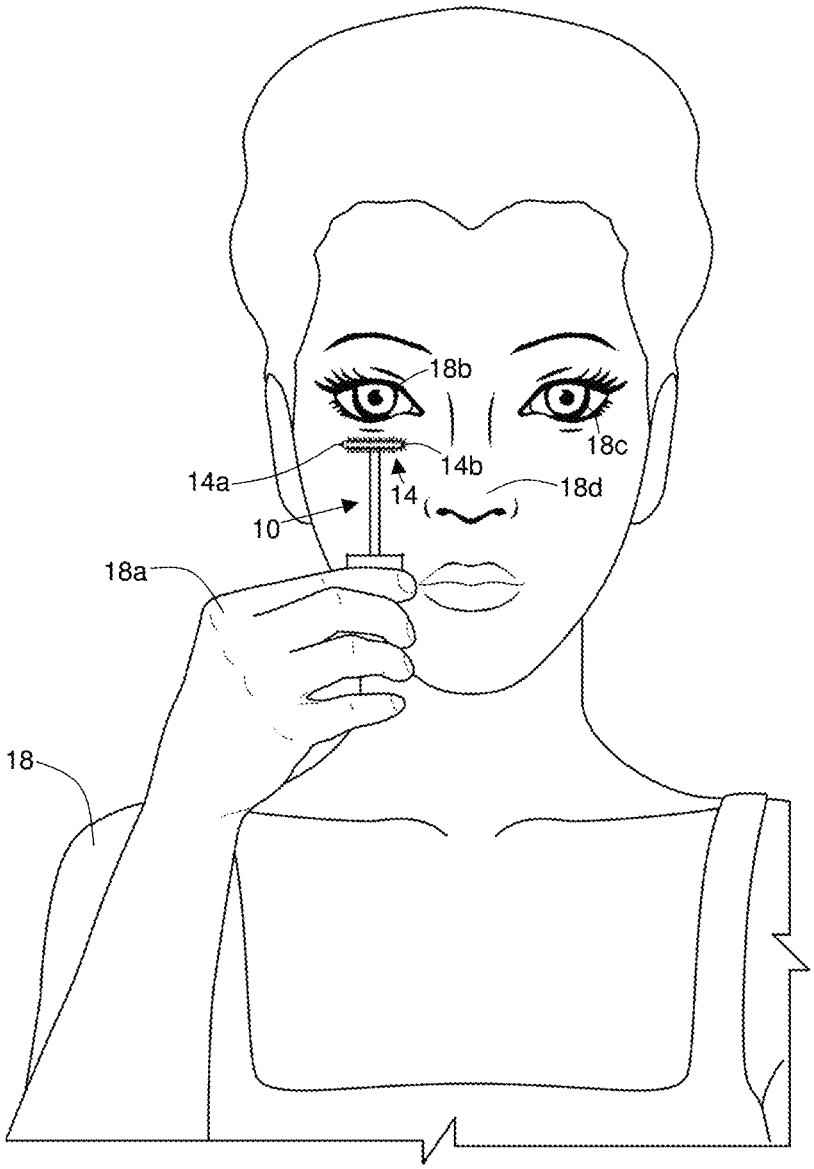
FIG. 13 is a front elevation view of the user holding the applicator in the dominant hand in a use position to apply mascara to the eye on the same side of the body as the dominant hand.

Turning to the inventor's method according to the invention, the method of using the applicator 10 of the invention 100 in a first step, the user 18 opens the container 16 or the prior art container and pulls out the applicator 10 with her dominant hand 18*a*. As the brush 14 moves out of the opening 16*a* of the container 16, the brush body 16*d* contacts the cleaning elements 16*b* that frictionally remove excess mascara 16*e* and redistribute the mascara 16*e* onto the brush body 14*d*. The user 18 can further wipe the brush 14 against the cleaning elements 16*b* as desired or needed. Turning to FIG. 13, the dominant hand 18*a* is positioned on a same side as a dominant eye 18*b* and the user 18 decides whether the ball end 14*b* or the tip end 14*a* faces the nose 18*d* of the user 18 by rotating the applicator 10 as desired or needed. These steps may also be reversed, where the user 18 decides whether ball end 14*b* or tip end 14*a* will face the nose 18*d* and then positions the dominant hand 18*a* on the same side as the dominant eye 18*b*. Mascara 16*e* is applied to the lashes of the dominant eye 18*b* using an up and down motion of the applicator 10 for both the upper and lower lashes, with the wand 10*c* positioned below the lashes being coated, contrasting with the prior art methods where the prior art wand of the prior art applicator and the lashes being coated form an approximately straight line. The ball end 14*b* is used to coat any remaining lashes near the nose 18*d*, if desired. The tip end 14*a* is used to separate the lashes as needed by pivoting the brush 14 while the dominant hand 18*a* is still positioned on a same side as the dominant eye 18*b*.

Figure 14:
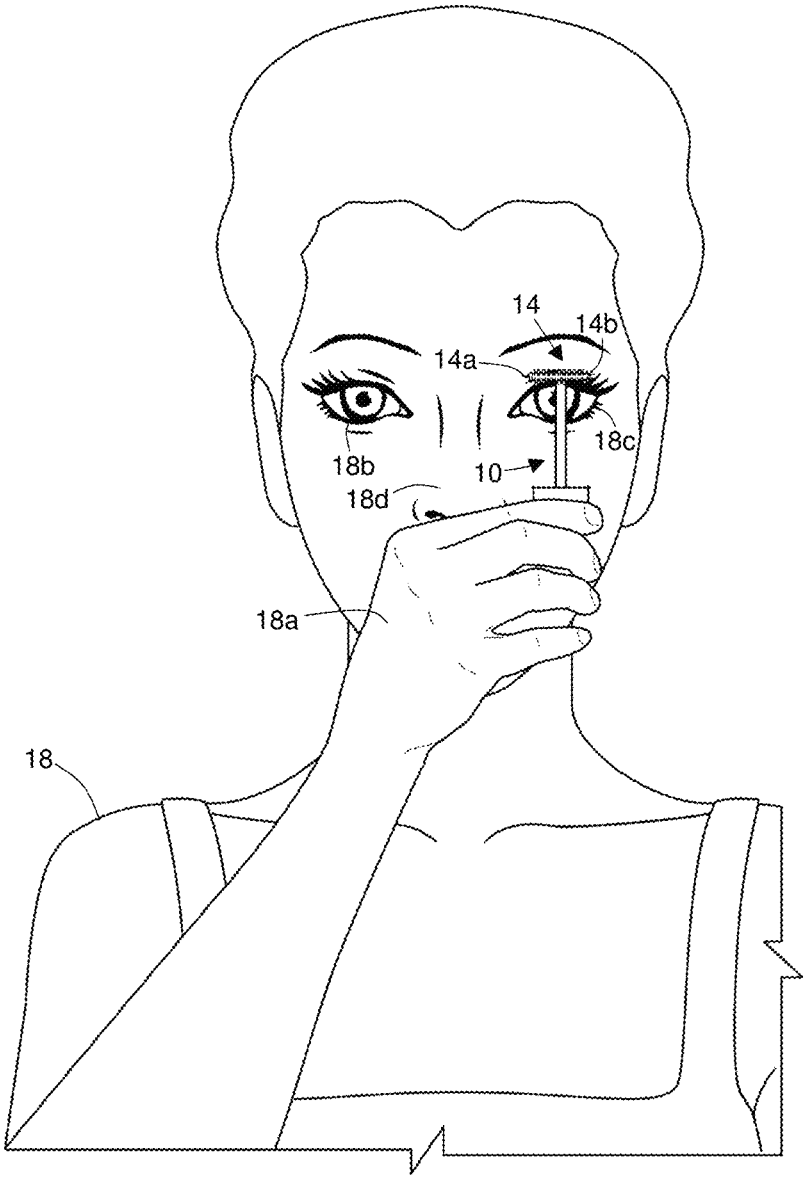
FIG. 14 is second front elevation view of the user in FIG. 13, showing the user holding the applicator in the dominant hand in a use position to apply mascara to the eye on the opposite side of the user's body as the dominant hand.

To apply mascara 16*e* to the nondominant eye 18*c*, as shown in FIG. 14, the user 18 moves the dominant hand 18*a* to an opposite side and repeats the steps performed with the dominant eye 18*b*. The user 18 can also start with the nondominant eye 18, if desired.

The applicator 10 allows the user 18 to maintain a same hand, hand position and application motion when applying mascara 16*e* to either the dominant or nondominant eye, something that is currently impossible with the prior art applicator 20 and method of use. In essence, the difference of mascara application between the dominant and nondominant eyes has been eliminated by the applicator 10. One far less common prior art method of applying mascara using the prior art applicator 20 and not shown in the FIGS. is to use a nondominant hand, not shown in the FIGS. to apply mascara to the nondominant eye 18*c*. This method eliminates the difference between mascara application between dominant and nondominant eyes but is seldom used given the high level of dexterity already required to apply mascara with the dominant hand 18*a* and the relative difficulty to clean up unwanted mascara without disturbing other previously applied makeup.

The clean and neat application of mascara is particularly important, since it is often a last or almost last step of makeup application and correction of mascara mistakes thus create more problems for the user 18 as base makeup or other skin preparations are now disturbed. The vertical application motion used by the applicator 10 and method is also easy to understand, and requires less dexterity, particularly with lower lashes that are small and notoriously difficult to coat evenly without disturbing other makeup while using the prior art applicator 20 and prior art methods. Importantly, the user's nose 18*d* now is not an obstacle to mascara application, as it is in the prior art, where the user's nose shape and nose bridge prominence can further complicate mascara application and is the reason for the different hand positions when attempting to apply mascara to the nondominant eye 18*c* in the prior art.

The inventor notes that the unique T-shape, L-shape, or hockey stick shape of her applicator 10 ensures that the user 18 can always use the ball end 14*b* to coat the inner lashes, regardless of use on the dominant 18*b* or nondominant eye 10*c*, and the tip end 14*a* provides an additional tool easily used immediately after mascara application using the method described herein, requiring no other external tools. Mascara dries quickly, so the ability to simply rotate the applicator 10 for lash separation facilitates this action and leads to better results. The inventor stresses that her applicator 10 has two useful ends of the brush 14, unlike the prior art applicator 20 where there is only a single useful tip end 22 and thus with the applicator 10, the user 18 has an extra built-in eyelash tool that is impossible to incorporate into the prior art applicator 20 due to its linear design.

The inventor notes that the linear design of the prior art applicator 20 is also a function of the prior art cylindrical container, and thus the inventor's container 16 is an improvement over the prior art container, providing more features that are not available with the prior art container, particularly that of removing excess mascara and even mascara distribution on the brush and allowing the user 18 to visualize the mascara 16*e* inside the container 16.

It is to be understood that the above-described arrangements are only illustrative of the application of the principles of the present invention. Numerous modifications and alternative arrangements may be devised by those skilled in the art without departing from the scope of the present invention. Since the brush 14 is largely perpendicular to the wand 10*c* of the applicator 10 (i.e., between 90 degrees and 135 degrees), the vexing problem of the prior art with dominant/nondominant hands and eyes is eliminated by the invention 100 described herein. Application of mascara is simplified: the user 18 holds the brush 14 near each eye and its lashes and the application motion is unhindered by the location of the nose 18*d*. This motion is more ergonomic and equally easy for the user 18 to self-apply mascara or for a professional makeup artist to apply mascara to a client. The inventor notes that makeup artists have similar issues applying mascara to clients as those who self-apply mascara, except the dominant hand 18*a* of the makeup artist has an easier time of applying mascara to the nondominant eye 18*c* of the client, but more difficulty with the dominant eye 18*b*. The applicator 10, method and container 16 allow the user 18 to apply mascara easily to any eye, and to separate any clumping eyelashes easily and quickly by rotating the brush to the tip end 14*a*. The inventor notes that the pointed tip of the first eyelash tool does not absorb any mascara product and thus is easily wiped clean of mascara when the wand is pulled out of the container and thus ready to separate lashes even before any mascara is applied. Having the mascara application brush and eyelash separator together in a single tool is more effective for clump free mascara application as compared to the prior art of separate tools, since mascara dries fast and the time it takes to put the wand down and pick up the separate eyelash separation tool allows some especially fast drying mascaras to dry enough that lash separation is compromised. The inventor notes that her applicator 10 as shown in the FIGS. is reminiscent of a big floor push broom, and results in more useful brush surface area compared to that of the prior art applicator brush 24 where the prior art tip 22 is predominantly the most useful part of the applicator 20.

Visual differences in mascara application to the dominant and nondominant eyes are unattractive, instantly recognizable, and a common problem for users of every skill level. Users with hand or arm dexterity issues in particular find that mascara application is difficult or impossible, and the rise in popularity of more expensive false eyelashes is related to the difficulties of applying mascara using the prior art applicator 20 and methods. While there are many self-application false eyelashes available, they are difficult to use and require even more dexterity than mascara application. Most users desire a natural but enhanced lash look that is possible with good mascara application, but the prior art applicator 20 and methods make this natural enhance look difficult to achieve. Self-application false lashes are even more difficult to use than mascara.

The inventor notes the rise of businesses whose sole service is to apply false eyelashes, and the materials and methods used can be damaging long term to the user's eyelashes. Glue allergies and skin irritation are common, as are loss of eyelashes. Regular maintenance is also required, similar to manicures, and thus the cost and time requirement for false eyelashes is prohibitive and inconvenient to many users. In contrast, mascara can be made to nourish and protect lashes as well as enhance them and is a relatively inexpensive and quick way to enhance the user's visual attractiveness. The inventor's applicator 10, container 16 and method provide those seeking to enhance their lashes a convenient and inexpensive way of doing so, along with environmental and other advantages of the present invention.

We claim:

1. An applicator for applying mascara, comprising:

a brush having a brush body with a first end and an opposed second end with an array of bristles between the first end and the second end, and a wand attachment point;

a wand having a lid end affixed to a lid and a brush end affixed to the wand attachment point of the brush;

wherein the wand is attached to the brush body such that the brush has an angle measuring between approximately 80 to 135 degrees as measured from the wand when the brush is in a use position;

wherein the first end is a first outermost end of the brush body and the opposed second end is a second outermost end of the brush body;

wherein the wand attachment point is either between the first end and the opposed second end of the brush body, or at either the first end or the opposed second end of the brush body;

wherein the first end is further comprised of a first eyelash tool and the opposed second end is further comprised of a second eyelash tool;

wherein the first eyelash tool is an eyelash separating tool having a pointed end made of a resilient, non-absorbent, and flexible material adapted to separate lashes coated with mascara;

wherein the first eyelash tool is not a bristle; and wherein a position of the wand in relationship to the first end and the opposed second end does not obstruct the first eyelash tool and the second eyelash tool.

2. The applicator in claim 1, wherein the opposed second end is further comprised of either a ball-like array of bristles or a plurality of bristles projecting away from the opposed second end.

3. The applicator in claim 1, further comprising a container having a rectangular lateral cross section.

4. The applicator in claim 1, wherein the wand attachment point of the brush is a center of the brush body.

5. The applicator in claim 1, wherein the brush is one of pivotably or foldably affixed to the wand.

6. The applicator in claim 5, wherein the wand is hingeably affixed to the brush.

7. The applicator in claim 1, wherein the wand attachment point of the brush is to either a right side or a left side of a center of the brush body.

8. The applicator in claim 1, wherein the brush is rotatably affixed to the wand.

9. The applicator in claim 1, wherein the applicator is T-shaped.

10. The applicator in claim 1, wherein the applicator is L-shaped or hockey stick shaped.

11. A mascara container adapted for use with the applicator in claim 1, comprising:

a container body having a rectangular opening;

an interior space having a rectangular cross-section accessed through the rectangular opening; and a plurality of finger-like cleaning elements arranged on opposed sides of the rectangular opening and wherein the plurality of finger-like cleaning elements is spaced apart relationship such that the rectangular opening is partially closed and a center of the rectangular opening is unobstructed.

12. The mascara container in claim 11, further comprising a window formed into the container body, wherein the interior space is visible through the window.

13. The mascara container in claim 11, wherein the cleaning elements are removably affixed to the rectangular opening.

14. The mascara container in claim 11, wherein the cleaning elements are made of silicone.

15. A method of applying a quantity of mascara to a user's first set of eyelashes and second set of eyelashes using a mascara applicator with a wand and a brush, with the brush angled between approximately 80 degrees and 135 degrees from the wand, the brush further having a tip end and a ball end, the tip end being made of a resilient, flexible and non-absorbent material for use as an eyelash separator, and a mascara container housing a quantity of mascara, the method comprising the steps of:

removing the applicator from the mascara container with a user's dominant hand;

positioning the dominant hand and the applicator on either a left side or a right side of a user's nose near the first set of eyelashes to be coated;

holding the applicator such that the wand is either approximately vertical and perpendicular to or below the first set of lashes to be coated;

moving the applicator and brush up and down to coat the first set of eyelashes;

rotating the brush so the tip end faces the first set of lashes;

orienting the tip end between individual lashes that are stuck together;

combing the tip end between the individual lashes that are stuck together to separate them;

positioning the dominant hand and the applicator to an opposite side of the user's nose near the second set of eyelashes to be coated; and repeating the steps of holding, moving, rotating, orienting, and combing until the second set of eyelashes are coated.

16. The method in claim 15, further comprising the steps of:

coating a plurality of eyelashes closest to the user's nose using the ball end of the brush;

before or after the step of moving.

17. The method in claim 15, wherein the mascara container further comprises a rectangular opening with cleaning elements positioned on opposed sides of the opening, and the method further comprises the step of:

redistributing mascara product on the brush by moving the brush against the cleaning elements;

after the step of removing and before the first step of positioning.

18. The method in claim 15, wherein the first step of positioning is further comprised of positioning either the ball end of the tip end closest to the user's nose.

* * * * *